US005224902A

United States Patent [19]

Stremler

[11] Patent Number: 5,224,902

[45] Date of Patent: Jul. 6, 1993

[54] APPARATUS WITH PENDULUM MOTION FOR BALANCING AT LEAST ONE PERSON

[75] Inventor: Jean P. Stremler, Boulogne Billancourt, France

[73] Assignee: Artix S.A., Breteuil sur Noye, France

[21] Appl. No.: 758,609

[22] Filed: Sep. 12, 1991

[30] Foreign Application Priority Data

Oct. 30, 1990 [FR] France ..... 90 13749

[51] Int. Cl.[5] ..... A63G 9/02

[52] U.S. Cl. ..... 472/118; 297/245; 297/273

[58] Field of Search ..... 472/118, 125, 120, 124; 297/245, 273

[56] References Cited

U.S. PATENT DOCUMENTS 154,322 8/1874 Davis ..... 297/245

3,447,802 6/1969 Grudoski ..... 472/125 X 4,190,248 2/1980 Philippi ..... 472/125 X

*Primary Examiner*—Richard E. Chilcot, Jr.

*Attorney, Agent, or Firm*—Kerkam, Stowell, Kondracki & Clarke

[57] ABSTRACT

An apparatus for pendulum motion for balancing at least one person or user in a plane, generally parallel to the ground, is characterized in that an extension for a footrest is carried by the suspension member further from the seat, and the extension of the suspension member is arranged in such a manner that, in the position of equilibrium of the apparatus, despite its connection to a suspension member remote from the seat in question, the footrest for the feet of the user of the seat is placed vertically downward of the means for pivotal connection of the suspension member closest to the seat in question.

2 Claims, 2 Drawing Sheets

APPARATUS WITH PENDULUM MOTION FOR BALANCING AT LEAST ONE PERSON

FIELD OF THE INVENTION

The invention relates to an apparatus for pendulum motion for balancing at least one person.

More particularly, but not exclusively, the invention relates to a play apparatus for children, commonly known as a see-saw swing.

BACKGROUND OF THE INVENTION

Specifically, the invention relates to an apparatus of the type described in U.S. Pat. No. 2,800,949, that is, an apparatus for balancing at least one person in a plane substantially parallel to the ground, essentially by the force of the action on a control device by the feet of the person.

In addition to a fixed support such as an overhead suspension framework, an apparatus of this type includes:

at least one seat supported by a beam located approximately parallel to the seat;

at least two rigid suspension members, which are connected, substantially parallel to one another, by pivotal connection to the fixed support and to the beam in such a manner as to constitute a parallelogram of elements, which is deformable in the plane perpendicular to the ground, known as the balancing plane.

In this apparatus:

each seat that faces a suspension member is located on the beam at a distance from the axis by which the beam is pivotally connected to the closest suspension means, approximately the distance between the seat and the pivot axis of the knees of a majority of users of the apparatus when they are seated on the seat in question, and the aforementioned suspension members extend below the plane of the seat so that, in a position of equilibrium of the apparatus, it has a footrest for the feet of the user located substantially vertically downward of the aforementioned pivotal connection.

In this way, the user can generate and/or maintain the balance sought of the seat, and then slow down the motion, solely by the controlled use of his legs.

Only the part of the lower limbs of the human extending from the knee to the foot is involved in a practical sense in this action.

Although the apparatus with pendulum motion of the type described above properly functions, nevertheless, the apparatus does not allow the user to efficiently develop a thrusting action of his entire lower limbs.

OBJECT AND SUMMARY OF THE INVENTION

An object the invention seeks to attain is an apparatus of the aforementioned type that makes it possible to exploit the extension of the entire lower limbs of each user to generate and/or maintain the pendulum motion.

To this end, the subject of the invention is an apparatus of the type described above, characterized in particular in that:

first, instead of being carried by the suspension means closest to each seat, an extension having the footrest for the feet of the user on the seat is carried by the suspension means farthest away from that seat, and second, the extension of the suspension means is arranged in such a manner that, in a position of equilibrium of the apparatus, despite its connection to a suspension means remote from the seat in question, the footrest for the feet of the user is located vertically below the pivotal connection means for the suspension means closest to the seat in question.

The invention will be better understood from the ensuing description, made by way of non-limiting example, in conjunction with the accompanying drawing.

DESCRIPTION OF THE PREFERRED EMBODIMENT

Figure 1:
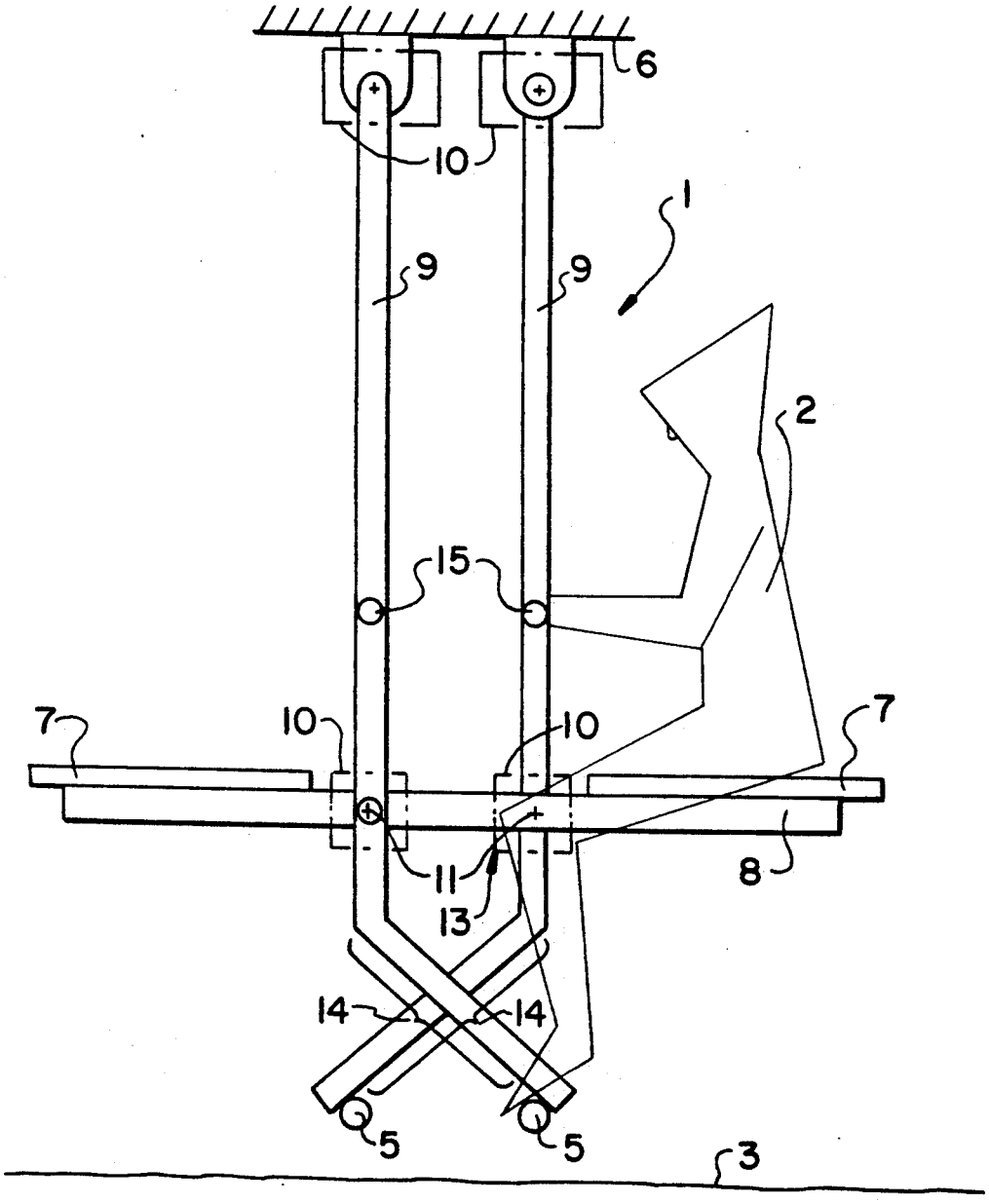
FIG. 1 is a profile view of an apparatus according to the invention.
Figure 2:
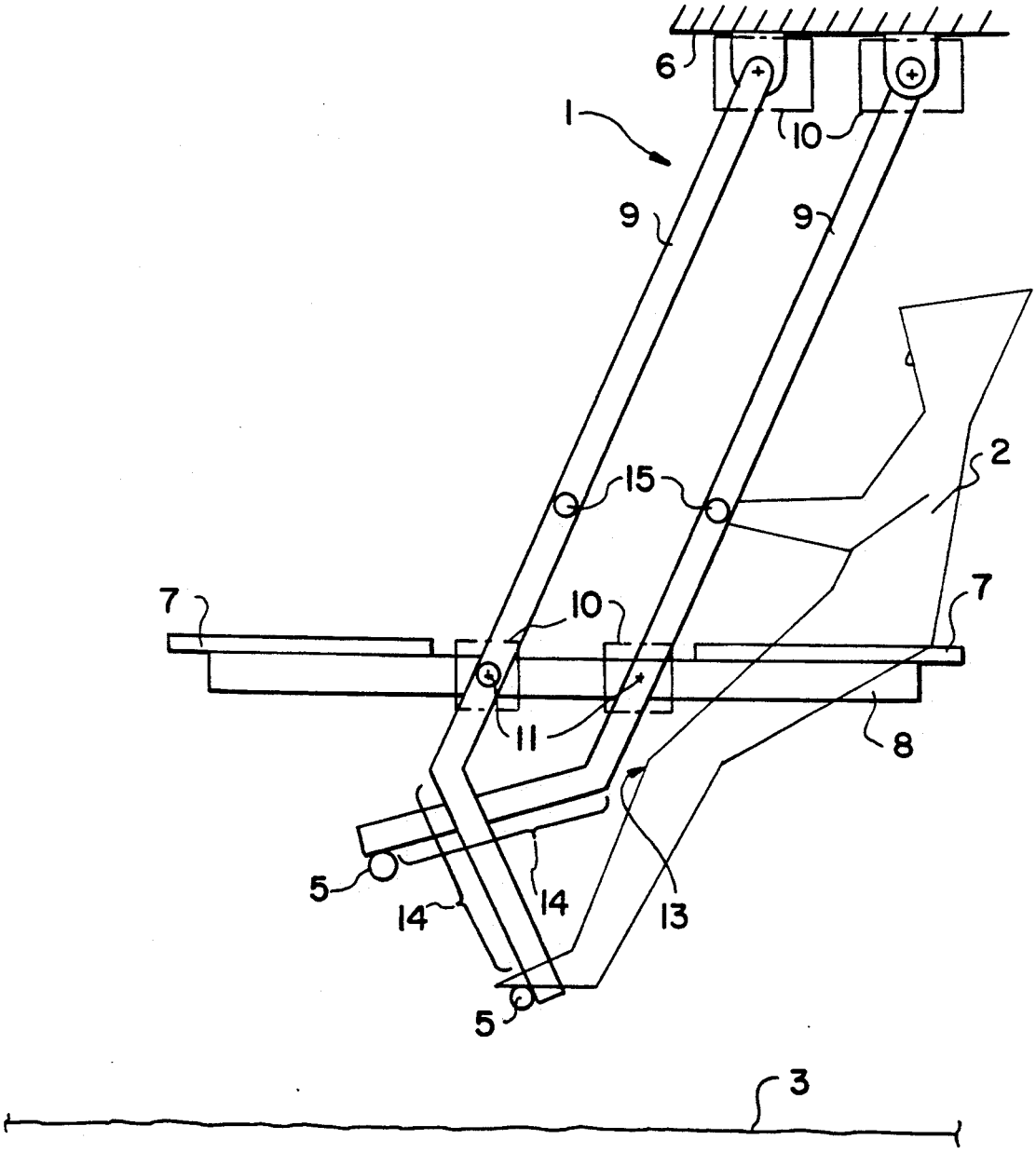
FIG. 2 shows the apparatus of FIG. 1 in use.

Turning now to the drawing, an apparatus 1 with pendulum motion for balancing at least one person 2, or user (outlined in fine lines) is seen, the balancing being effective in a plane that is generally parallel to the ground 3.

The balancing is generated and/or maintained by the action of the feet 4 of the user upon a footrest device 5.

Besides a support 6 such as an overhead suspension framework, the apparatus shown includes:

at least one seat 7 supported by a beam 8, the longitudinal axis of which is substantially parallel to the balancing plane, at least two rigid suspension members 9, substantially parallel to one another, are connected by pivotal connecting means 10 to the suspension support 6 and to the beam 8 in such a way as to constitute, with these elements, a deformable quadrilateral, such as a parallelogram, in a plane approximately perpendicular to the balancing plane. The beam formed of at least one member and/or the suspension member is of any known type, and in particular chrome-plated, metal.

In this apparatus, first, each seat 7 is located on the beam 8 facing a suspension member and at a distance from the axis 11 of the means 10 for pivotal connection of the suspension means to the beam, which corresponds approximately to the distance between the seat and the pivot axis of the knees 13 of the intended users when they are seated on the seats 7, and second, the footrest device 5 for supporting the feet 4 of the user of each seat is carried by an extension 14 of the suspension means 9, which, in the position of equilibrium of the apparatus, has the footrest 5 below and at right angles to the seat 4 of the user and substantially vertically below the pivotable connection means 10 closest to the seat in question.

According to the invention:

first, instead of being carried by the suspension means 9 closest to this seat, the extension 14 having the footrest 5 for the feet 4 of the user of this seat is carried by the suspension means 9 farthest away from that seat, and second, this extension 14 of the suspension means 9 is arranged in such a manner that in the position of equilibrium of the apparatus, despite its connection to a suspension means remote from the seat 7 in question, the footrest 5 for the user of this seat is positioned vertically below the means 10 for pivotally connecting the suspension means closest to the seat 7.

Preferably, the apparatus includes two seats facing one another, and each of the two suspension means of the apparatus is provided with an extension 14 arranged in accordance with the characteristic of the invention.

This technical feature makes it possible for the user to develop a true action generating deformation of the parallelogram, since the footrest can be displaced by extending the limbs of the user.

In fact, each footrest for the feet of a user, who develops the action against this device, can be moved effectively farther away from the pivotal connection of the means that is next to the seat on which the user sits.

Preferably, each suspension means has a handle 15 for each user to hold onto.

I claim:

1. An apparatus for pendulum motion for balancing at least one person, or user, in a plane generally parallel to the ground, comprising a support, such as an overhead suspension framework, and:

at least one seat supported by a beam, the longitudinal axis of which extends substantially parallel to the ground, at least two rigid suspension members are connected, substantially parallel to one another, by pivotal connecting means to the suspension support and to the beam in such a manner as to form a quadrilateral, such as a parallelogram, that is deformable in the balancing plane.

in which apparatus has:

at least on seat located on the beam facing a suspension member at a distance from said axis of the suspension member for pivotally connecting the suspension member to the beam, which corresponds approximately to the distance between the seat and the pivot axis of the knees of an intended user when seated on the seat, and a footrest device for supporting the feet of the user of the at least one seat carried by an extension of the suspension member, which, in the position of equilibrium of the apparatus, has said footrest at right angles to the seat and substantially vertically downward of the pivotal connecting means closest to the seat in question, said apparatus being characterized in that first, instead of being carried by the suspension member closest to the seat, the extension having the footrest for the user of said seat is carried by the suspension member farthest away from that seat, and second, said extension of the suspension member is arranged in such a manner that, in the position of equilibrium of the apparatus, despite its connection to a suspension member remote from said seat, said footrest for the feet of the user of this seat is positioned vertically below the means for pivotal connection of the suspension member closest to the seat in question.

2. The apparatus, as defined in claim 1, wherein the said beam carries a pair of seats, one adjacent each suspension member.

* * * * *